United States Patent [19]

Carlyle

[11] 4,157,622

[45] Jun. 12, 1979

[54] FASTENER FOR FOOTWEAR

[76] Inventor: Lance J. Carlyle, 120 Williams St., Cambridge, New Zealand

[21] Appl. No.: 836,680

[22] Filed: Sep. 26, 1977

[51] Int. Cl.[2] ..... A43C 11/00

[52] U.S. Cl. ..... 36/50; 24/68 SK; 24/205.17; 254/79

[58] Field of Search ..... 24/68 SK, 68 R, 71 R, 24/71 SK, 71 TD, 71 CT, 71.1, 205.17, 273; 36/50; 254/52, 79

[56] References Cited

U.S. PATENT DOCUMENTS

| | | | |
|---|---|---|---|
| 176,022 | 4/1876 | Marsh | 24/205.17 |
| 499,419 | 6/1893 | Fathers | 24/68 SK |
| 808,028 | 12/1905 | Ellis | 24/71 SK |
| 925,763 | 6/1909 | Embry | 24/273 |
| 972,062 | 10/1910 | Conard | 24/205.17 |
| 2,994,935 | 8/1961 | Buchholz | 24/205.17 |
| 3,262,167 | 7/1966 | Martin | 24/68 SK |

*Primary Examiner*—Kenneth J. Dorner
*Attorney, Agent, or Firm*—Stevens, Davis, Miller & Mosher

[57] ABSTRACT

A fastener for footwear having two opposed lacing flaps has a rotatable elongated body member having two oppositely disposed groups of two or more arms. The arms of each group are pivotally and eccentrically connected to the body member and are arranged in a series along the body member which allows pivotal movement of the arms along a substantially common axis opposite that of the other group. The arms are engageable with the flaps. Rotation of the body member alters the relative positions of the axes to draw the flaps together and the body member can be locked at a selected position of rotation.

12 Claims, 18 Drawing Figures

FIG 5
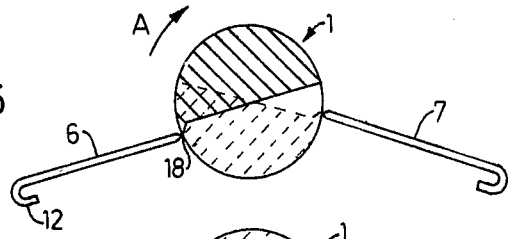
FIG 6
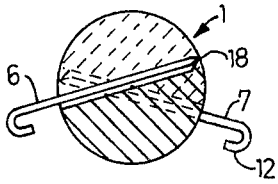
FIG 7
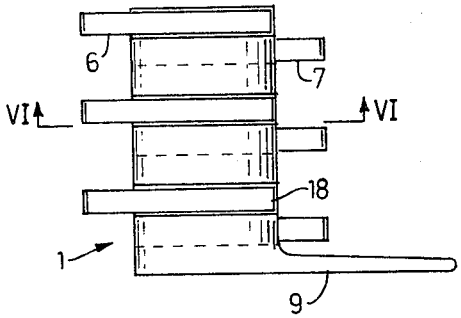
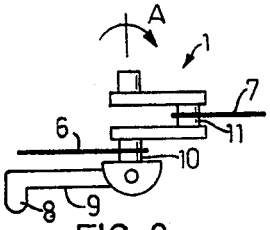
FIG 8
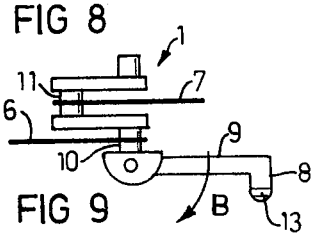
FIG 9
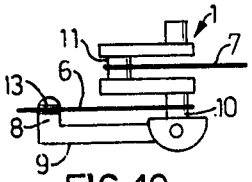
FIG 10
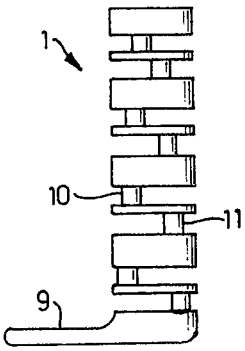
FIG 11

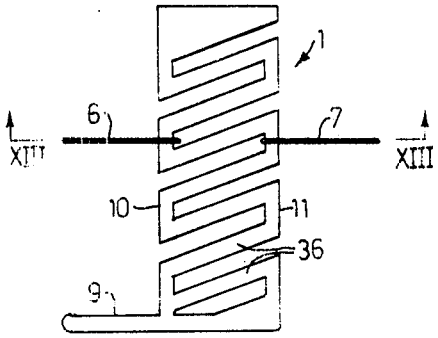
FIG 12
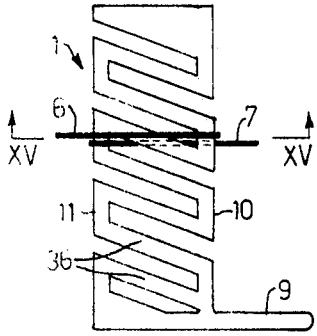
FIG 14
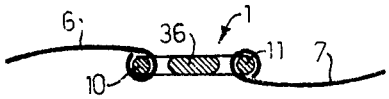
FIG 13
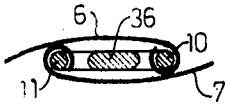
FIG 15
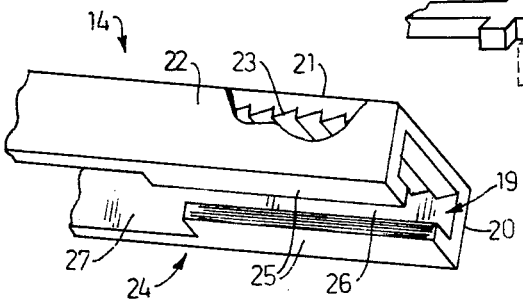
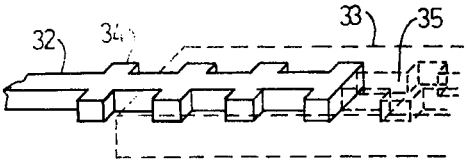
FIG 17
FIG 16
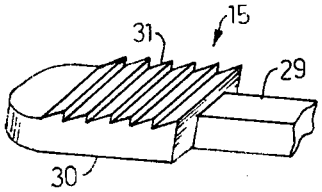
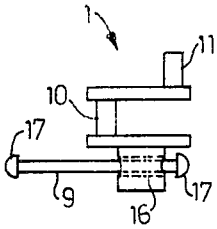
FIG 18

FASTENER FOR FOOTWEAR

BACKGROUND OF THE INVENTION (a) Field of the Invention

This invention is concerned with improvements in/or relating to footwear and relates particularly to the means of fastening an article of footwear on the foot of a person and the removal of the article of footwear after use.

(b) Description of the Prior Art

At present it is common for articles of footwear, such as shoes and boots for example, to have, forming part of the upper portion of the article of footwear, two lacing flaps either side of and overlapping the tongue of the article of footwear. Each of these flaps is usually provided with a number of eyes through which a lace is threaded. To fasten the article of footwear on the foot of a person the lace is first tensioned to draw the flaps together somewhat so that the article of footwear is a firm but comfortable fit on the foot and the lace is then tied in a bow. To remove the article of footwear the lace is untied and with the tension on the lace released the flaps can be separated sufficiently to enable the article of footwear to be removed from the foot of the person. It is often an inconvenience with this method of fastening an article of footwear that the laces wear with time and break or inadvertently become undone and it was with this problem in mind that the present invention was devised.

U.S. Pat. Nos. 228,946 and 3,262,167 describe and illustrate two fastenings for footwear which do not require laces to be used. However the shoe fastening of Specification No. 228,946 allows only a single connection to be made between the fastening and each lacing flap which may be a disadvantage in adequately and comfortably securing the footwear on a foot and the fastening of Specification 3,262,167 has a large number of parts which must be made separately and then assembled, this resulting in a relatively expensive product.

SUMMARY OF THE INVENTION

This invention relates to an improved fastening for an article of footwear.

Broadly the present invention consists in a fastener for an article of footwear having two opposed lacing flaps, said fastener comprising a rotatable elongated body member having two groups each of two or more attached arms, each group being oppositely disposed, said arms being pivotally and eccentrically connected to said body member, the arms of each group being arranged in a series along the body member and connected to the body member for pivotal movement along a substantially common axis opposite that of the other group, the arms having engaging means engagable with the lacing flaps, and means to rotate the body member to alter the relative position of said common axes and means to lock the body member at a selected position of rotation.

In a second aspect the present invention consists in an article of footwear having a fastener as defined above.

DESCRIPTION OF THE DRAWINGS

Preferred forms of the invention will be described with reference to the accompanying drawings in which:

FIG. 5 shows a cross sectional view through a fastener moulded from a plastics material, the arms of the fastener being attached to the body member by means of plastic hinges, the fastener being shown in the released position, FIG. 6 shows a cross sectional view corresponding to that of FIG. 5 but with the fastener in the fastened position, FIG. 7 shows a plan view from above FIG. 6 (FIG. 6 is in fact a section on VI—VI of FIG. 7), FIGS. 8, 9 and 10 show a form of the invention where the body member has a handle which is pivotally mounted to an end of the body member to provide one form of body member locking means, FIG. 11 shows a plan view of an alternative form of body member, FIG. 12 shows a further alternative form of body member showing only two arms in the released position, FIG. 13 is a section on XIII—XIII of FIG. 12, FIG. 14 corresponds to FIG. 12 but shows the fastener in the fastened position, FIG. 15 is a section on XV—XV of FIG. 14, FIG. 16 illustrates an arm which is adjustable in length, FIG. 17 illustrates an alternative arm which is adjustable in length, and FIG. 18 shows a further form of the body member having an alternative body member locking means.

DETAILED DESCRIPTION OF THE INVENTION

By this invention a fastener is provided for use in place of the laces commonly used to fasten an article of footwear on the foot of a person. The article of footwear, which may be a shoe or a boot for example, is of the type having two opposed lacing flaps 2 and 3 forming part of the upper portion or vamp of the article of footwear. The two flaps are located either side of and overlap the tongue 4 of the footwear. If the fastener of this invention is to be used with a conventional article of footwear then each of the flaps will normally have a number of eyes 5 provided for the lace usually used.

Figure 1:
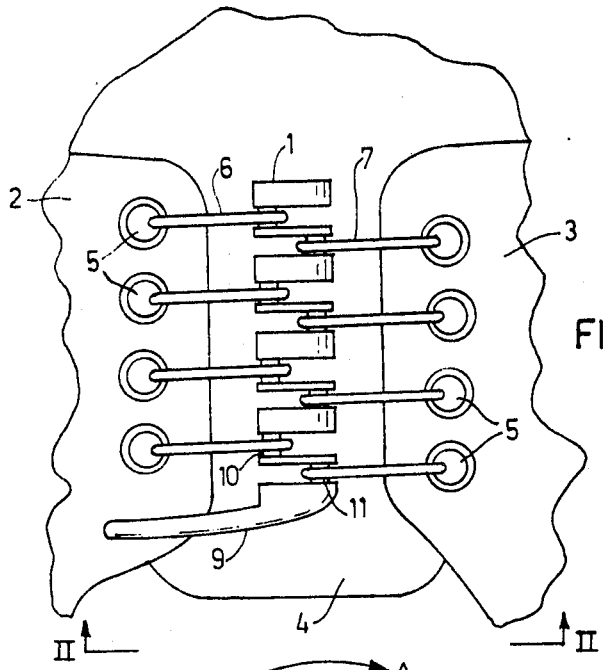
FIG. 1 shows a plan view of a part of the upper portion or vamp of an article of footwear showing a first preferred form of the fastening and its attachment to lacing flaps of the footwear, the fastener being shown in a released position.
Figure 2:
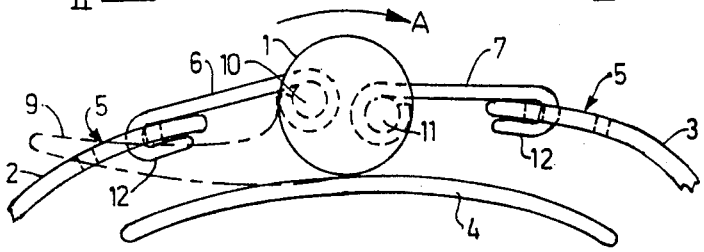
FIG. 2 shows an end elevation (to a larger scale) on II—II of FIG. 1, the fastener being shown in the released position.
Figure 3:
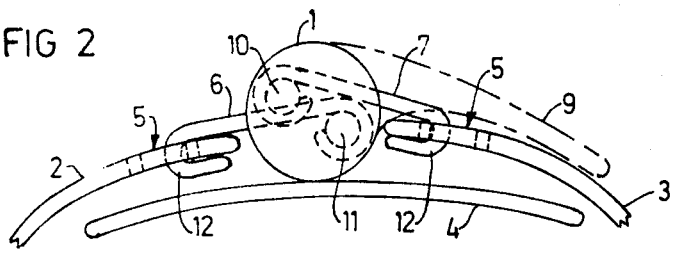
FIG. 3 shows an end view corresponding to that of FIG. 2 but showing the fastener in a fastened position.

According to this invention the fastening comprises a rotatable elongated body member 1 having two groups of two or more attached arms, each group being oppositely disposed. The arms are pivotally and eccentrically connected to the body member, the arms of each group being arranged in a series along the body member and being connected to the body member for pivotal movement along a common axis opposite that of the other group. The arms have engaging means engagable with the lacing flaps. In the example shown in FIG. 1 there is one group of four arms 6 which are engaged with the flap 2 and there are four arms 7 in a second group, these arms being engaged with the flap 3. The fastener also has means to rotate the body member to alter the relative positions of the common axes, and means to lock the body member at a selected position of rotation. The rotating means is conveniently provided by a handle 9 attached to one end of and disposed to one side of the body member. With reference to FIGS. 1–3 of the accompanying drawings the body member is in the form of a crankshaft machined or cast from a metal or alternatively moulded from a suitable plastics material. Use of a plastics material allows the body member to have some flexibility. A glass reinforced plastics material such as that sold under the trade name 'Delron' is preferred. Similarly, the arms 6 and 7 can be made from metal such as steel wire or can be made from a plastics material.

In the form of the invention illustrated in FIGS. 1–3 the crankshaft has four cranks 10 to which the arms 6 are pivotally attached at one end and four opposite cranks 11 to which the arms 7 are pivotally attached at one end. Preferably the cranks are circular in cross section and each arm is formed with a loop in one end this loop passing about one of the cranks to provide the pivotal connection with the body member. At its opposite end each arm has a hook 12 which passes through an eye 5 of a flap to engage the arm and hence the fastener with the article of footwear.

FIGS. 1 and 2 of the drawings show the fastener in the released position where the flaps are separated somewhat so that the article of footwear can be placed on a foot of a person. When the footwear is placed on the foot the handle 9 is used to rotate the crankshaft in the direction of the arrow A shown in FIG. 2 and this rotation of the crankshaft causes tension to be applied to the flaps to pull these closer together thereby fastening the footwear on the foot. FIG. 3 shows the position of the fastener and the flaps of the footwear in the fastened position. In the preferred arrangement the body member is rotated through an angle greater than 180° to an overcentre locking position so that the tension forces acting on the body member through the arms 6 and 7 apply a turning moment still acting to turn the body member in the direction of arrow A so that the body member is retained or locked in the fastened position (as further rotation of the body member is prevented by the handle 9 which presses against the flap 3). If the body member is rotated through a smaller angle then the turning moment acting on the body member would cause this to rotate back towards the released position when the handle was released unless some other suitable locking means is provided to prevent this. In this case the locking means would be provided by a releasable interaction between the body member and a member engaged with the footwear or a part of the footwear.

Such a suitable alternative locking means is illustrated in FIGS. 8–10 of the accompanying drawings. In this form of the invention the handle 9 is pivotally mounted at the end of the body member and has a tab 8 at its free end. FIG. 8 shows a portion of the body member with two arms 6 and 7 and the handle 9 in the released position. Rotation of the body member in the direction of arrow A moves this to the fastened position shown in FIG. 9. The pivotal handle is now swung back in the direction of arrow B so that the tab 8 can engage under the arm 6 and above the tongue or flap of the footwear against which the handle presses. A groove 13 can be provided in the tab to positively locate this under the arm 6.

A further alternative locking means is shown in FIG. 18. In this case the handle is in the form of a rod or bar which is slidable through a hole 16 in the end of the body member but is retained in the hole by expanded ends or stops 17. Once the handle has been used to rotate the body member to the fastened position the handle is slid through the hole 16 to project on the opposite side of the body member to press against the tongue or flap of the footwear and prevent counter-rotation to the released position until the handle is slid back again.

In an alternative form of the invention illustrated in FIGS. 5–7 the fastener is moulded from a plastics material and the arms 6 and 7 are moulded integrally with the body member, these being joined by means of a plastic hinge 18 as it is only necessary that the arms be pivotal to some extent (through approximately 180°) and it is not necessary that they be fully rotatable about their pivot points or axis. In this case the construction and manufacture of the fastener is considerably simplified.

Figure 4:
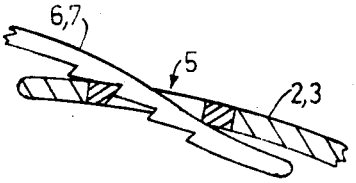
FIG. 4 shows a cross sectional view illustrating an arrangement whereby adjustment is provided in the length of an arm between the body member and its point of engagement with a flap of the article of footwear.

A disadvantage of the forms of the invention described above is that in the fastened position the flaps are drawn together by a predetermined amount and no variations are possible. In a modification of the invention each arm has the means engagable with the flaps of the article of footwear provided for adjustment between the two. One preferred arrangement is illustrated in FIG. 4 where each arm 6 or 7 is serrated towards its free end, any one of the serrations being engagable with the eye 5 or slot through which the free end of the arm is passed so that the fastener can be adjusted to suit the requirements of different persons. The serrations could be located on either one of or both of the sides of the arm. Instead of using the eyes of the flaps of the article of footwear for the engagement between the footwear and the fastener there may instead be an elongated strip attachable to each flap, the arms being engagable with this engaging strip.

FIG. 16 shows an alternative arrangement whereby the length of an arm is adjustable. In this case each arm is made in two parts 14 and 15 and at one of its ends each part is adjustably engagable with the other part and at its other end each part is either pivotally connected to the body member or has engaging means for engagement with a lacing flap. Part 14 comprises a housing having a rectangular cross section (though other cross sectional shapes can be used). The housing is hollow, is open at one end 19, and is enclosed on three sides 20, 21 and 22. Inside the housing the side 21 has a series of serrations 23. The fourth side 24 of the housing towards the opening 19 comprises in effect two flanges 25 located on opposite sides of a narrow slot 26. The flanges 25 terminate away from the opening to the housing so that the slot 26 communicates with a larger open slot 27 where the side 24 is completely open. Arm part 15 comprises a narrow shank 29 having an expanded head 30 the upper surface of which has a plurality of serrations 31. In use, the head 30 is inserted through the opening 19 of the housing 14 so that the serrations 23 and 31 engage. The serrations are shaped to allow movement of the head 30 further into the housing but prevent the part 15 from being pulled back from the housing. The plurality of serrations also allow the head 30 to be engaged in the housing 14 in a plurality of positions, this providing adjustability of the length of the arm, this being shorter the further the head is inserted into the housing. To separate parts 14 and 15 the head 30 is pushed sufficiently far into the housing so that it can drop through the enlarged opening 27 and the shank 29 can pass through the narrowed slot 26.

FIG. 17 shows another form of arm which is adjustable in length. In this case arm part 32 has a plurality of equally spaced lateral projections 34 and arm part 33 has a similarly shaped recess 35 into which the end of part 32 can be fitted in a number of positions catering for variations in the length of the arm depending how far along part 33 the part 32 is positioned before being pushed into the recess 35. The lateral projections of both the part 32 and the recess are preferably flared slightly towards their bottoms (as shown in FIG. 17) so that part 32 is a snap fit in the recess to prevent inadvertent disengagement but to allow deliberate disengagement of the two arm parts.

A modification of the invention is illustrated in FIG. 11 which shows a body member in the form of a crankshaft where the common axis of one group of cranks is angled with respect to the common axis of the other group of cranks. This arrangement gives the cranks of the body member towards the handle a greater 'throw' than towards the other end of the body member and by this means the two opposite lacing flaps can be drawn together more tightly at the top end of the footwear than towards the toe end.

In those forms of the invention previously described the arms 6 are offset somewhat with respect to the arms 7, in other words they are not directly opposite each other. However, a modification of the invention illustrated in FIGS. 12–15 has an arrangement whereby an arm 6 and an arm 7 can be pivotally connected to the body member substantially opposite each other, the arms then being substantially aligned. The body member which is in the form of a crankshaft has two groups of cranks as before but each crank of one group has another crank positioned directly oppositely the webs 36 connecting adjacent cranks being sufficiently angled to permit this. The arms 6 and 7 are curved to avoid interference with the webs on rotation of the body member to the fastened position. With the pairs of arms 6 and 7 substantially aligned there is no tendency for the lacing flaps to twist on being drawn together.

The above describes the preferred form of the invention and indicates some possible modifications but other modifications can be made to the fastener without departing from the scope of the invention. The body member can have various cross sectional shapes depending on the functional and aesthetic requirements of the article of footwear. It is envisaged that the invention may be of particular use with work shoes and work boots but the invention is not limited to these particular articles of footwear.

I claim:

1. A fastener for an article of footwear having two opposed lacing flaps, said fastener comprising a rotatable elongated body member having two groups of attached arms, each of which has at least two arms, each group being oppositely disposed, said arms being pivotally and eccentrically connected to said body member, the arms of each group being arranged in a series lengthwise along the body member and connected to the body member for pivotal movement along a substantially common axis opposite that of the other group, the arms having engaging means engagable with the lacing flaps, and means to rotate the body member, the axis of rotation of the body member lying lengthwise with respect to the body member, to alter the relative position of said common axes.

2. A fastener as claimed in claim 1 including means to releasably lock the body member and to the article of footwear.

3. A fastener as claimed in claim 1 wherein the means to rotate the body member is a handle attached and disposed to one side of the body member.

4. A fastener as claimed in claim 1 wherein the arms are hooked at their ends to provide said engaging means.

5. A fastener as claimed in claim 1 wherein each arm between the body member and the engagement has means to adjust the length of the arm with respect to a lacing flap.

6. A fastener as claimed in claim 1 wherein the body member comprises a crankshaft.

7. A fastener as claimed in claim 7 wherein the crankshaft has a plurality of cranks for each group of arms and each crank of one group has a crank of the other group positioned substantially oppositely.

8. A fastener as claimed in claim 1 wherein the body member and the arms are moulded from a plastics material and each arm is pivotally and integrally attached to the body member by means of a plastic hinge.

9. A fastener as claimed in claim 1 wherein the pivotal axis of one group of arms is angled with respect to the pivotal axis of the other group of arms.

10. A fastener as claimed in claim 1 wherein the fastener has means to lock the body member at a selected position of rotation.

11. A fastener as claimed in claim 7 wherein the arms of one group are attached to the crank shaft directly oppositely the attachment to the crank shaft of the arms of the other group so that rotation of the crank shaft through more than 180° moves the fastener to an over center locking position.

12. A fastener as claimed in claim 1 in combination with an article of footwear having two opposed lacing flaps, said fastener being disposed between the lacing flaps with the arms of one group engaged with one lacing flap and the arms of the other group engaged with the other lacing flap.

* * * * *

UNITED STATES PATENT AND TRADEMARK OFFICE

CERTIFICATE OF CORRECTION

PATENT NO. : 4,157,622

DATED : June 12, 1979

INVENTOR(S) : Lance J. Carlyle

It is certified that error appears in the above–identified patent and that said Letters Patent are hereby corrected as shown below:

Column 6, line 16 (claim 2, line 2), delete "and".

Column 6, line 24,(claim 5, line 2), delete "between the body member and the engagement".

Column 6, line 44 (claim 11, line 1), delete "7" and replace with -- 6 --.

Column 6, line 30 (claim 7, line 1), delete "claim 7" and replace with -- claim 6 --.

Signed and Sealed this

*Twenty-fifth* Day of *March 1980*

[SEAL]

*Attest:*

SIDNEY A. DIAMOND

*Attesting Officer*

*Commissioner of Patents and Trademarks*